US009868569B2

(12) United States Patent
Wu

(10) Patent No.: US 9,868,569 B2
(45) Date of Patent: Jan. 16, 2018

(54) WATERPROOF STORAGE BOX

(71) Applicant: Yi-Ra Wu, Taichun (TW)

(72) Inventor: Yi-Ra Wu, Taichun (TW)

( * ) Notice: Subject to any disclaimer, the term of this patent is extended or adjusted under 35 U.S.C. 154(b) by 0 days.

(21) Appl. No.: 15/252,017

(22) Filed: Aug. 30, 2016

(65) Prior Publication Data

US 2017/0107021 A1 Apr. 20, 2017

(30) Foreign Application Priority Data

Oct. 14, 2015 (TW) ..... 104133621 A

(51) Int. Cl.
*B65D 43/16* (2006.01)
*B65D 43/24* (2006.01)
*B65D 51/00* (2006.01)

(52) U.S. Cl.
CPC ..... *B65D 43/161* (2013.01); *B65D 43/24* (2013.01); *B65D 51/00* (2013.01); *B65D 2251/105* (2013.01); *B65D 2251/1008* (2013.01)

(58) Field of Classification Search
CPC ..... B65D 43/161; B65D 43/16; B65D 43/24; B65D 43/169; B65D 51/00; B65D 51/18
USPC ... 220/826, 810, 254.6, 254.3, 254.2, 254.1, 220/832, 831, DIG. 11
See application file for complete search history.

(56) References Cited

U.S. PATENT DOCUMENTS 448,453 A * 3/1891 McLaughlin ..... 220/831
2,206,848 A * 7/1940 McAvoy ..... A45C 13/008 190/28
2012/0074158 A1* 3/2012 Lafleur ..... B25H 3/02 220/810
2014/0084009 A1* 3/2014 De Quevedo-Dominguez ..... B29C 44/569 220/524

* cited by examiner

*Primary Examiner* — Robert J Hicks
(74) *Attorney, Agent, or Firm* — DLA Piper LLP (US)

(57) ABSTRACT

A storage box includes a box body having an opening, an upper cover and a side cover. The upper cover has an upper cover body covering removably an upper opening portion of the opening of the box body, a waterproof segment connected to a portion of a periphery of the upper cover body, and two pivot segments connected respectively to opposite ends of the waterproof segment. The side cover has a side cover body covering removably a side opening portion of the opening of the box body, and a pivot section connected pivotally to the pivot segments and having a side edge connected to a portion of a periphery of the side cover body. The pivot section is covered by and received in the waterproof segment of the upper body.

9 Claims, 9 Drawing Sheets

WATERPROOF STORAGE BOX

CROSS-REFERENCE TO RELATED APPLICATION

This application claims priority of Taiwanese Invention Patent Application No. 104133621, filed on Oct. 14, 2015.

FIELD

The disclosure relates to a storage box, more particularly to a storage box with waterproof property.

BACKGROUND

Referring to FIG. 1, a conventional storage box 1 includes a hollow box body 11, and first and second covers 12, 13 for removably covering the hollow box body 11. The second cover 13 is connected to and rotatory relative to the first cover 12 so that the storage box 1 is openable to for accessing articles in the hollow box body 11. Additionally, the second cover 13 has an edge formed with a plurality of long grooves 131 for rotatory engagement of the first cover 12 therewith. However, a gap is formed between the first cover 12 and the second cover 13. Water may permeate the hollow box body 11 through the gap when the storage box 1 comes accidentally in contact with the water, and thus, the protection effect of the conventional storage box 1 needs improvement.

SUMMARY

Therefore, the object of the disclosure is to provide a storage box and an assembly for a storage box that can alleviate the drawback of the prior art.

According to one aspect of the present disclosure, a storage box includes a box body, an upper cover and a side cover. The box body defines a receiving space and has an opening in spatial communication with the receiving space. The opening has an upper opening portion and a side opening portion. The upper cover has an upper cover body, a waterproof segment and two pivot segments. The upper cover body covers removably the upper opening portion of the opening of the box body. The waterproof segment has opposite ends, and a side edge that interconnects the opposite ends and that is connected to a portion of a periphery of the upper cover body. The two pivot segments are connected respectively to the opposite ends of the waterproof segment. The side cover has a side cover body and a pivot portion. The side cover body covers removably the side opening portion of the opening. The pivot section has opposite ends connected respectively and pivotally to the pivot segments of the upper cover, and a side edge that interconnects the opposite ends and that is connected to a portion of a periphery of the side cover body. The pivot section is covered by and received in the waterproof segment of the upper body.

According to another aspect of the present disclosure, a cover assembly adapted for covering removably a box body of a storage box includes an upper cover and a side cover. The box body defines a receiving space, and has an opening in spatial communication with the receiving space. The opening has an upper opening portion and a side opening portion. The upper cover of the cover assembly has an upper cover body, a waterproof segment and two pivot segments. The upper cover body is adapted for covering removably the upper opening portion of the opening of the box body. The waterproof segment has opposite ends, and a side edge that interconnects the opposite ends and that is connected to a portion of a periphery of the upper cover body. The two pivot segments are connected respectively to the opposite ends of the waterproof segment. The side cover has a side cover body and a pivot section. The side cover body is adapted for covering removably the side opening portion of the opening. The pivot section has opposite ends connected respectively and pivotally to the pivot segments of the upper cover, and a side edge interconnecting the opposite ends and connected to a portion of a periphery of the side cover body. The pivot section is covered by and received in the waterproof segment of the upper body.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
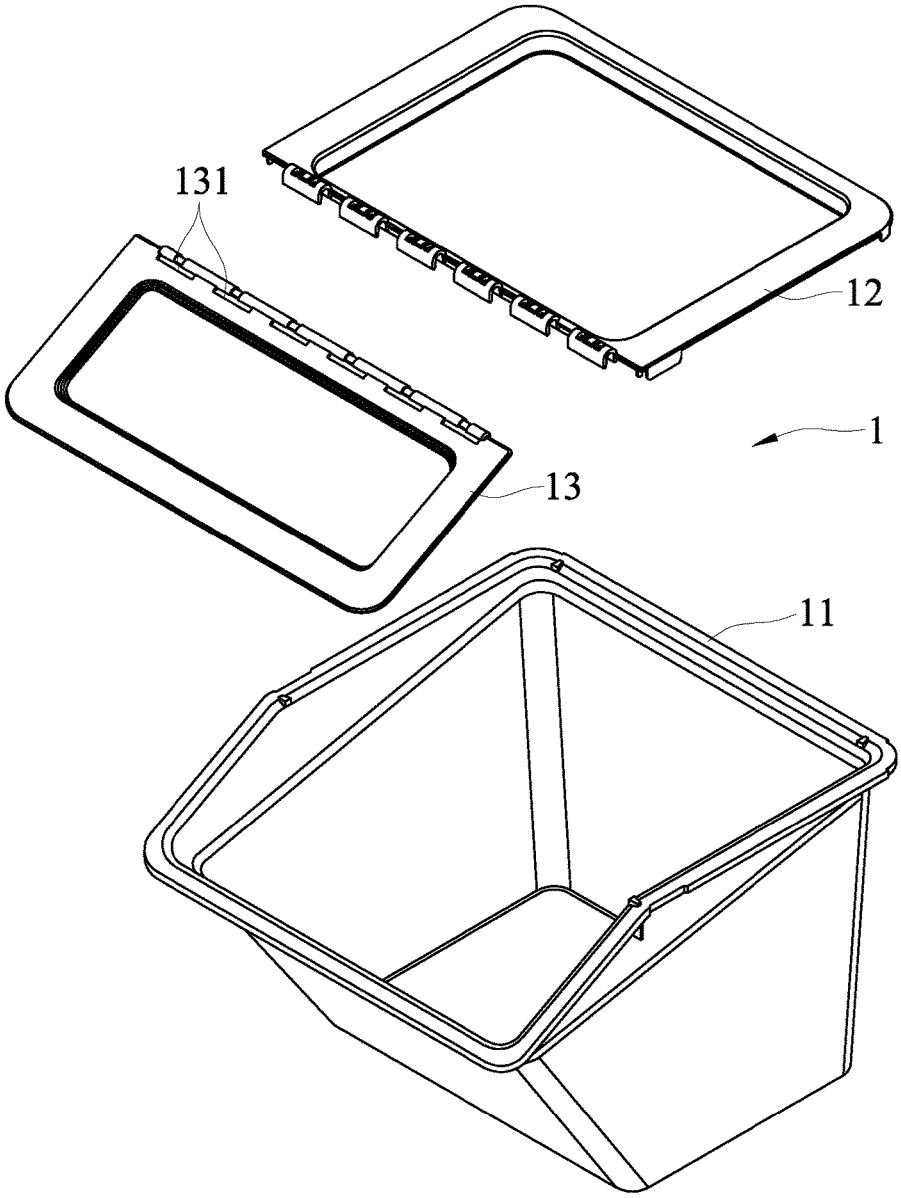
FIG.1 PRIOR ART
FIG. 1 is an exploded perspective view of a conventional storage box.
Figure 2:
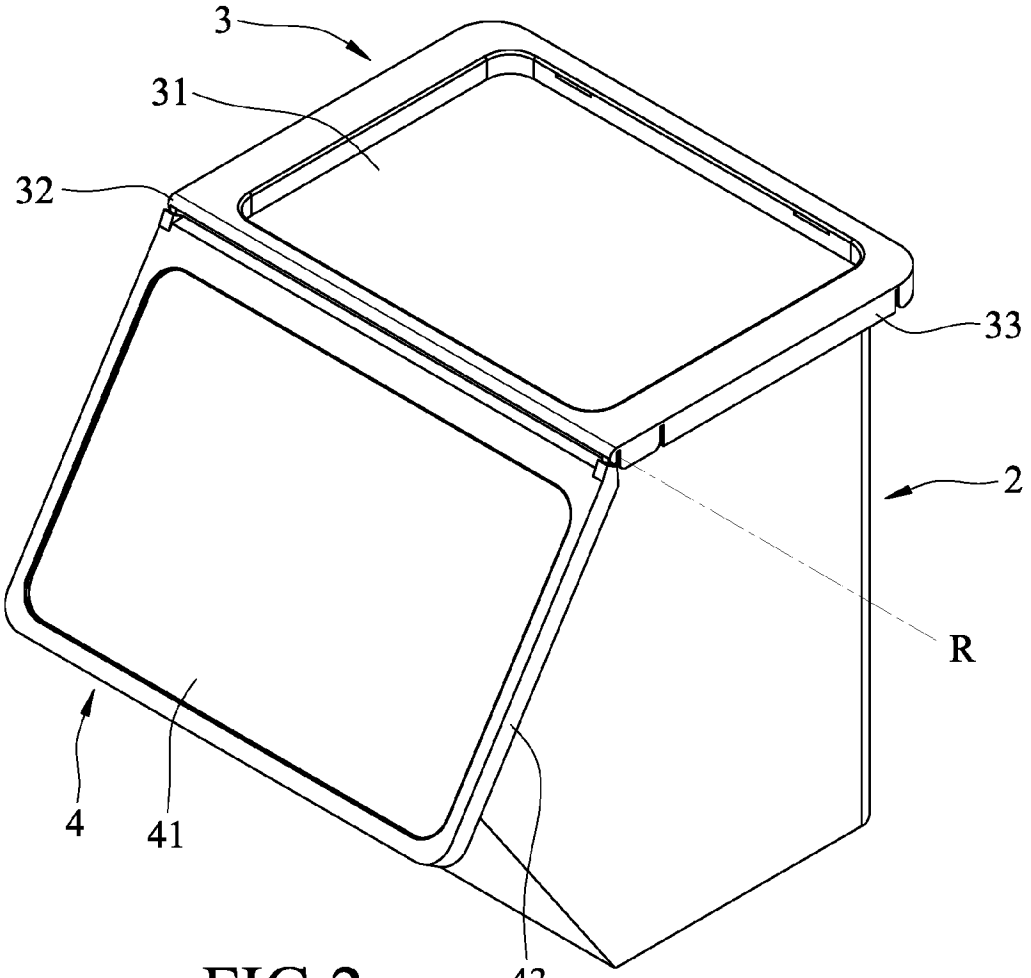
FIG. 2 is a perspective view illustrating an embodiment of a storage box of the disclosure.
Figure 3:
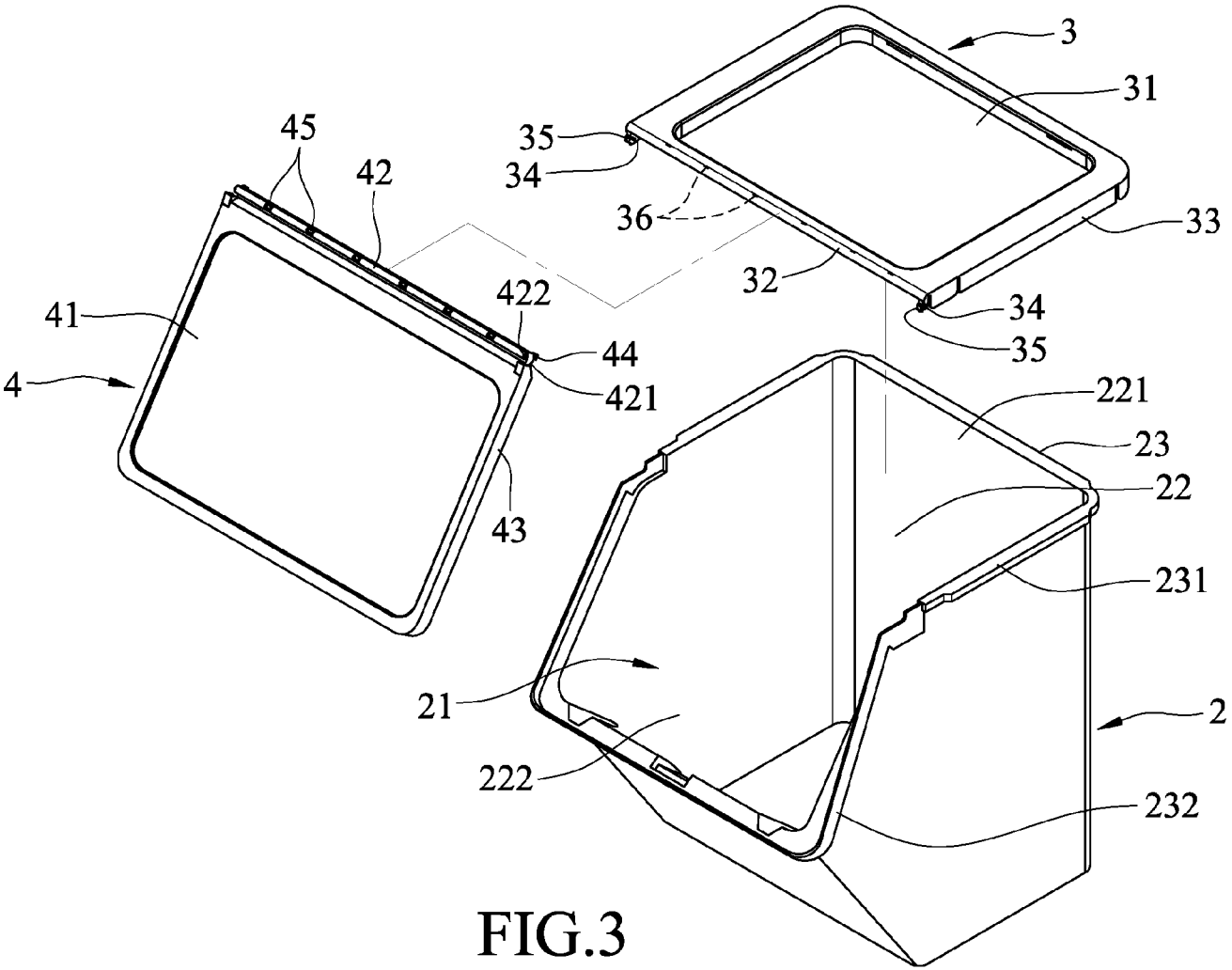
FIG. 3 is an exploded perspective view of the embodiment of FIG. 2.

Referring to FIGS. 2 and 3, the embodiment of a storage box according to the present disclosure includes a box body 2, and a cover assembly including an upper cover 3 and a side cover 4.

The box body 2 defines a receiving space 21, and has an opening 22 in spatial communication with the receiving space 21 and a support edge 23 defining the opening 22. The opening 22 has an upper opening portion 221 and a side opening portion 222. In this embodiment, the support edge 23 is exemplified to have an upper portion 231 that defines the upper opening portion 221 and extends slantingly and outwardly from the box body 2, and a side portion 232 that is connected to the upper portion 231, defines the side opening portion 222, and extends slantingly and outwardly from the box body 2.

Figure 4:
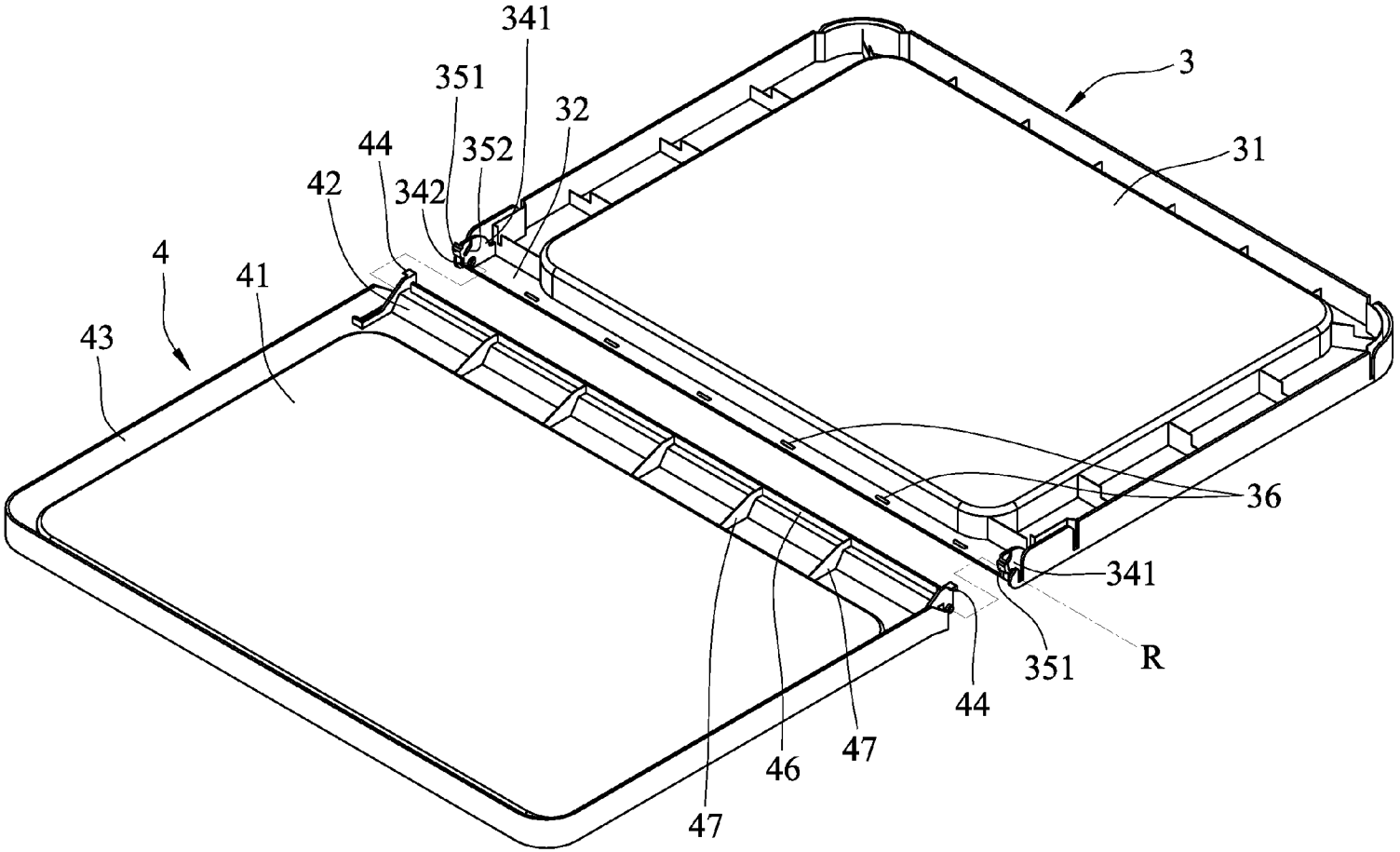
FIG. 4 is an exploded perspective view illustrating an embodiment of a cover assembly adapted to be included in the storage box of FIG. 2.
Figure 5:
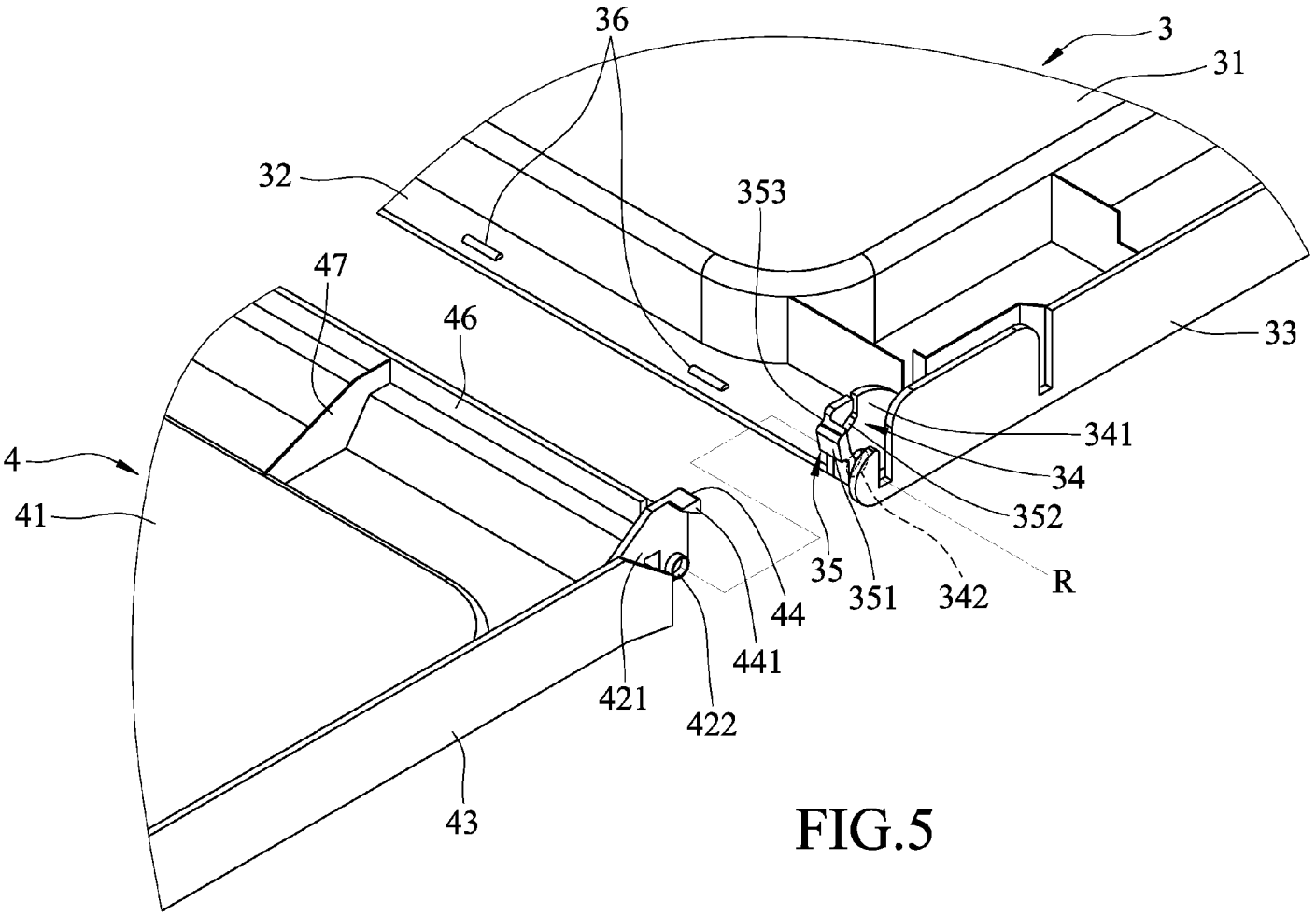
FIG. 5 is a fragmentary enlarged view of FIG. 4.
Figure 6:
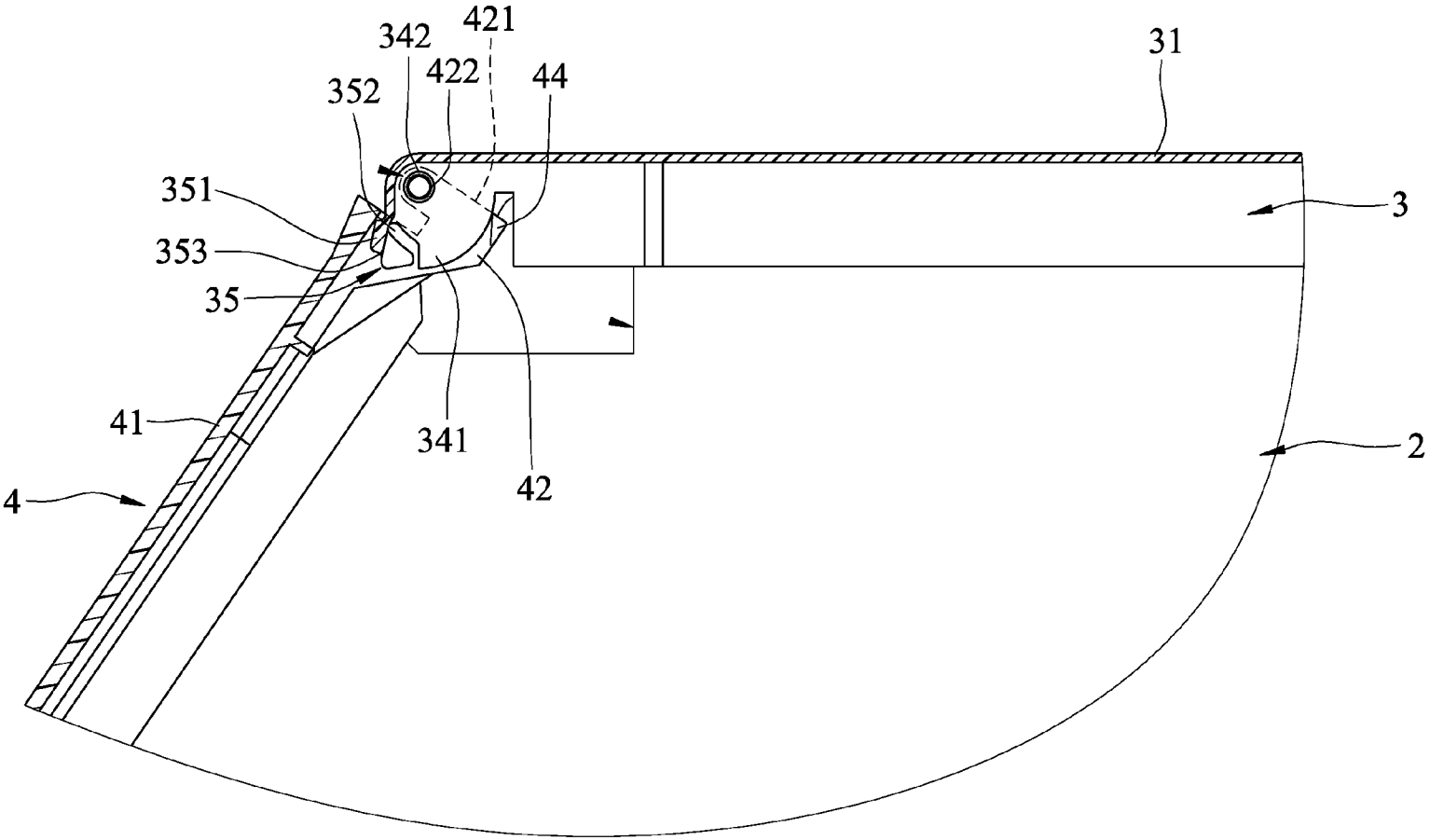
FIG. 6 is a fragmentary sectional view of the embodiment of FIG. 2 illustrating engagement of an upper cover with a side cover that is at a closed position.
Figure 7:
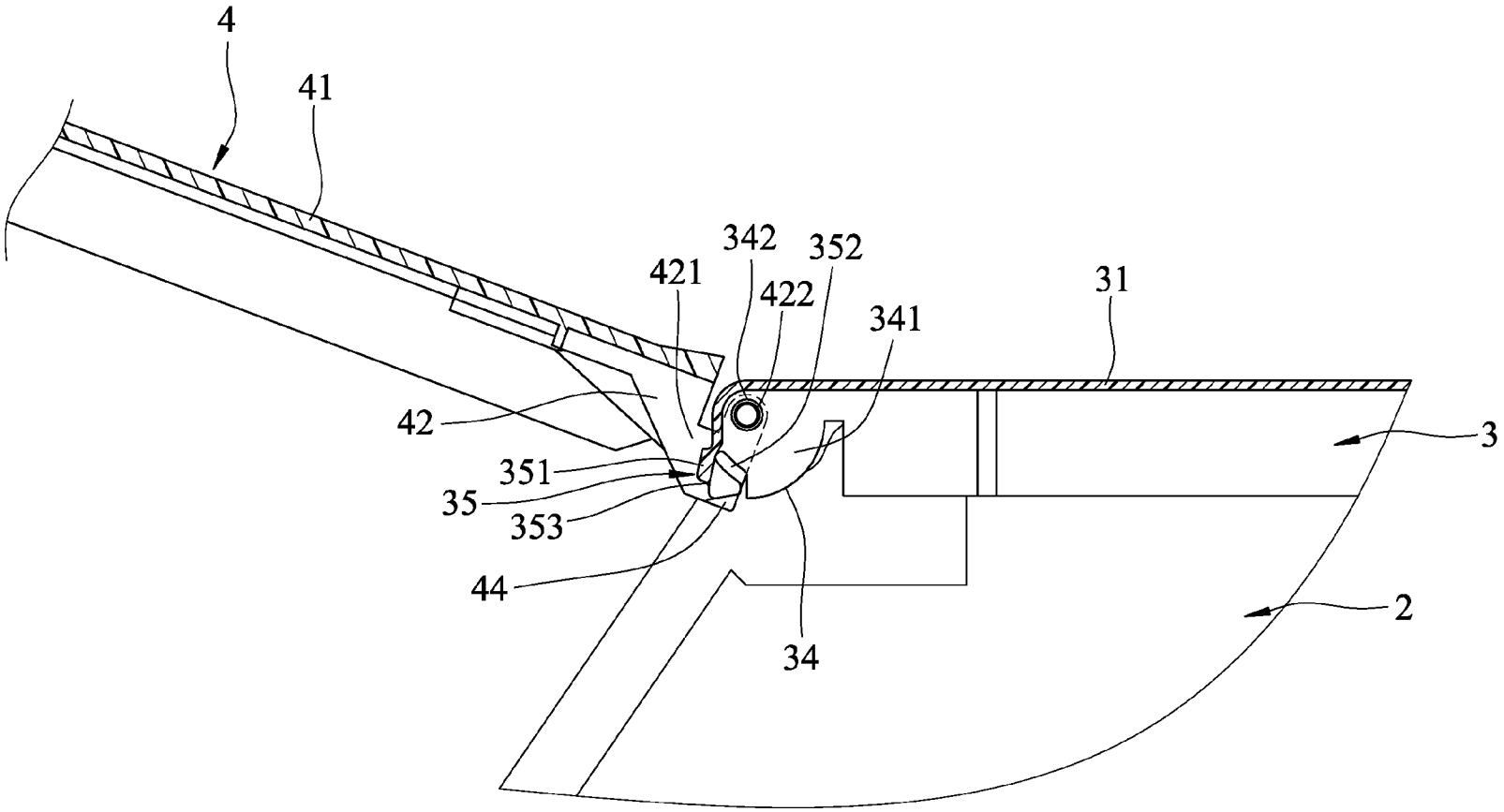
FIG. 7 is a fragmentary sectional view similar to FIG. 6 illustrating engagement of the upper cover with the side cover and pivotal movement of the side cover relative to the upper cover.
Figure 8:
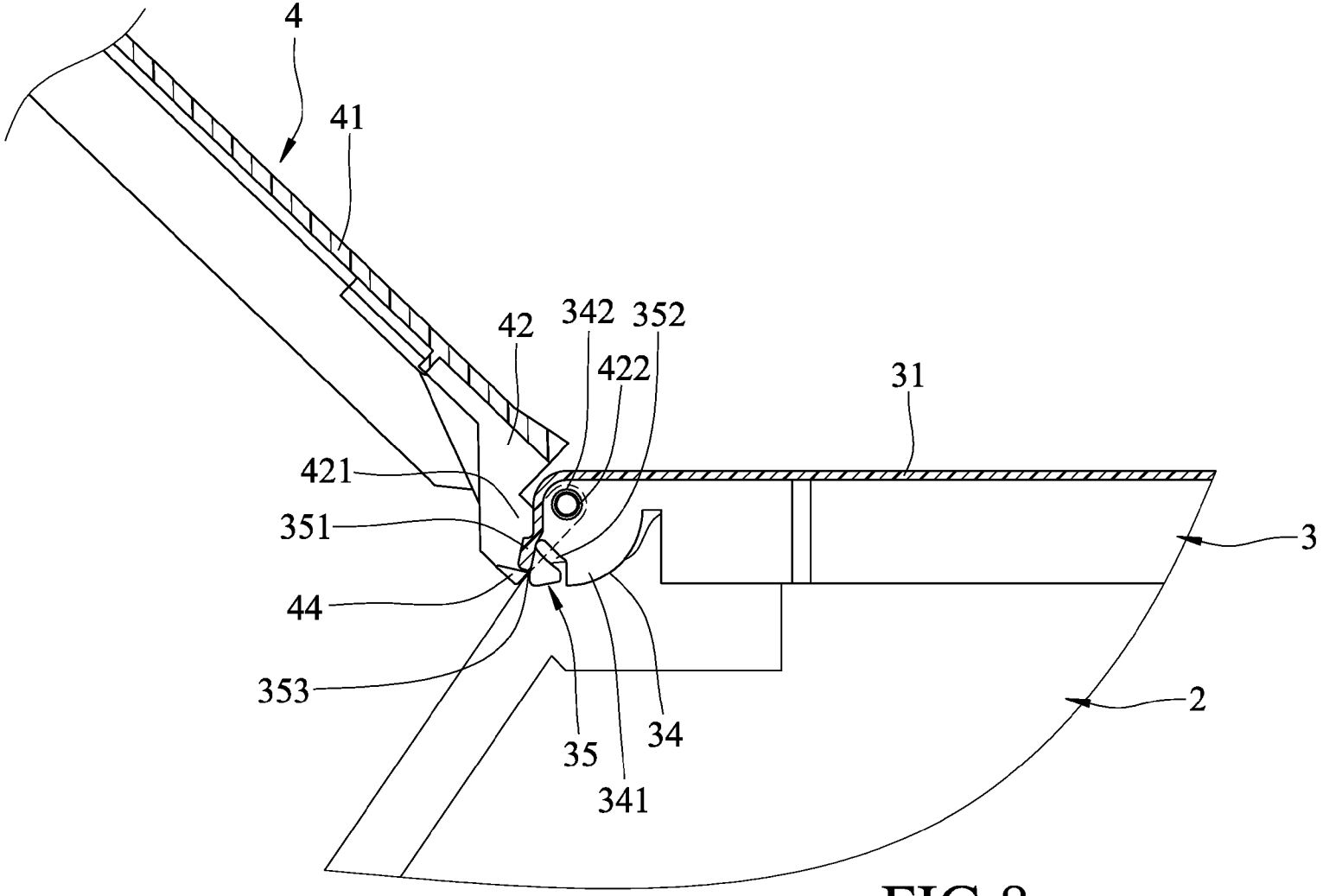
FIG. 8 is a fragmentary sectional view similar to FIG. 6 illustrating engagement of the upper cover with the side cover that is at an opened position.

Referring to FIGS. 3 to 5, the upper cover 3 has an upper cover body 31 covering removably the upper opening portion 221 of the opening 22 of the box body 2, a waterproof segment 32 having opposite ends and a side edge that interconnects the opposite ends and that is connected to a portion of a periphery of the upper cover body 31, an edge-covering segment 33 connected to the remainder of the periphery of the upper cover body 31 and coupled movably to the box body 2, two pivot segments 34 connected respectively to the opposite ends of the waterproof segment 32, two engaging segments 35 connected respectively to the pivot segments 34, and a plurality of limit protrusions 36 provided on the waterproof segment 32.

The pivot segments 34 of the upper cover 3 are symmetrical to each other. Each of the pivot segments 34 has a pivot plate 341 that is formed with a pivot hole 342, which extends in a lengthwise direction (R) of the waterproof segment 32. Each of the engaging segments 35 of the upper cover 3 has an extending member 351 that extends from the pivot plate 341 of a respective one of the pivot segments 34. The extending member 351 cooperates with the pivot plate 341 of the respective one of the pivot segments 34 to form a slot 352 therebetween to permit the extending member 351 to bend relative to the pivot plate 341 of the respective one of the pivot segments 34, and has an engaging groove 353.

The side cover 4 has a side cover body 41 covering removably the side opening portion 222 of the box body 2, a pivot section 42 having opposite ends that are connected respectively and pivotally to the pivot segments 34 of the upper cover 3, and a side edge that interconnects the opposite ends and is connected to a portion of a periphery of the side cover body 41. The pivot section 42 is covered by and received in the waterproof segment 32. The side cover 4 further includes an edge-covering section 43 connected to the remainder of the periphery of the side cover body 41 and coupled removably to the box body 2, two abutment sections 44 connected respectively to the opposite ends of the pivot section 42, a plurality of support blocks 45 provided on the pivot section 42 to be in positions corresponding to the limit protrusions 36 of the upper cover 3, a reinforcing plate 46 disposed on the pivot section 42 and extending along the direction (R), and a plurality of reinforcing ribs 47 connected to the side cover body 41, the reinforcing plate 46 and the pivot section 42. In this embodiment, the reinforcing plate 46 and the reinforcing ribs 47 are exemplified as being provided for strengthening the structure of the side cover 4 so as to extend the service life of the side cover 4. However, inclusion of the reinforcing piece 46 or the reinforcing ribs 47 is not mandatory when the storage box of the disclosure is put into practice.

The pivot section 42 has two pivot pieces 421 that are connected respectively to the opposite ends of the pivot section 42 and that are symmetrical to each other, and two pivot shafts 422 that extend respectively from the pivot pieces 421. Each of the pivot shafts 422 engages rotatably the pivot hole 342 of a respective one of the pivot segments 34. The abutment sections 44 of the side cover 4 extend respectively from the pivot pieces 421.

Referring to FIG. 3 and FIGS. 6 to 8, each of the pivot shafts 422 cooperates with the pivot hole 342 of the respective one of the pivot segments 34 to form a pivot mechanism. Each of the abutment sections 44 cooperates with the extending member 351 of a respective one of the engaging segments 35 to form an engaging mechanism. Hence, the side cover 4 is pivotable about the pivot portion 42 relative to the upper cover 3 between an opened position (see FIG. 8), where the side cover 4 uncovers the side opening portion 222 of the opening 22, and a closed position (see FIG. 6), where the side cover 4 covers the side opening portion 222. The abutment sections 44 of the side cover 4 abut respectively against the engaging segments 35 of the upper cover 3 when the side cover 4 is at the opened position for maintaining the side cover 4 at the opened position. Each of the abutment sections 44 engages the engaging groove 353 of a respective one of the engaging segments 35 of the upper cover 3 when the side cover 4 is at the opened position for maintaining the side cover 4 at the opened position. The limit protrusions 36 abut respectively against the support blocks 45 when the side cover 4 is at the opened position. The engagement positions of the limiting protrusions 36 and the support blocks 45 are aligned with the abutment positions of the abutment sections 44 and the engaging grooves 353 of the extending members 351 for better engagement of the upper cover 3 with the side cover 4, and the weight of the side cover 4 is shared by the abutment sections 44, the engaging segments 351, the limit protrusions 36 and the support blocks 45.

When assembling, the side cover 4 is firstly connected to the upper cover 3. The pivot shafts 422 respectively engage rotatably the pivot holes 342. Each of the pivot pieces 421 is adjacent to the pivot plate 341 of the respective one of the pivot segment 34. When each of the pivot shafts 422 is fitted into and rotates in the pivot hole 342 of the respective one of the pivot segment 34, each of the abutment sections 44 rotates relative to the corresponding extending member 351 (see FIG. 7) until each of the abutment sections 44 is limited by the corresponding engaging groove 353. The abutment sections 44 cannot position the side cover 4 by moving reversely in this state (see FIG. 8). The side cover 4 is pressed down to make the abutment sections 44 respectively push the extending members 351 to move toward the slots 352 so that the abutment sections 44 respectively disengage from the engaging grooves 353 of the engaging segments 35, and then rotate relative to the pivot plates 341 to a position where the side cover 4 is able to move to the closed position to cover the side opening portion 222 of the opening 2 (see FIG. 6).

Figure 9:
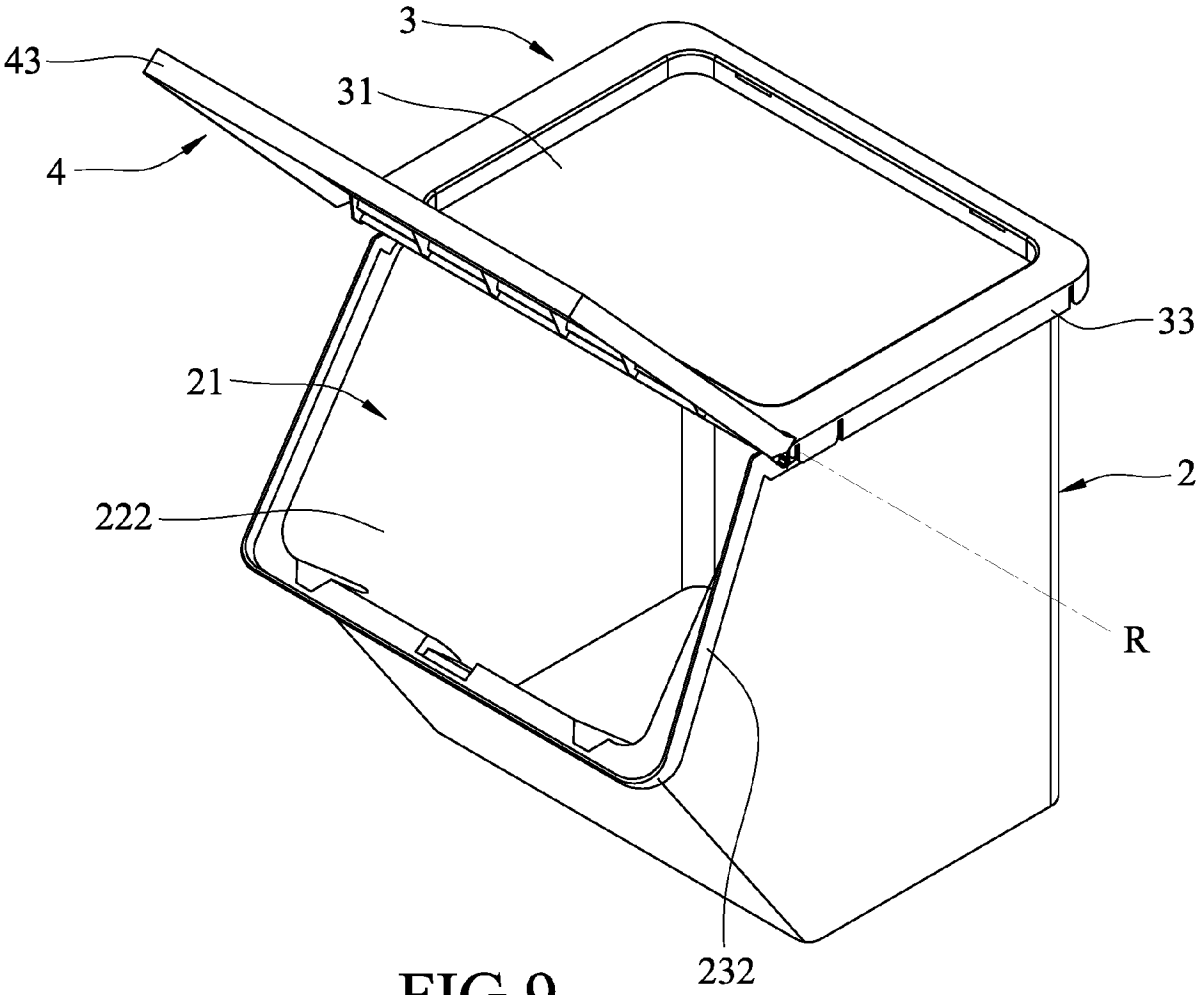
FIG. 9 is a perspective view of the embodiment of the storage box with the side cover at the opened position as shown in FIG. 8.

Referring back to FIGS. 2 and 9, when the upper cover 3 and the side cover 4 cover the upper opening portion 221 and the side opening portion 222 of the opening 22, the edge-covering segment 33 of the upper cover 3 and the edge-covering section 43 of the side cover 4 are coupled removably to the box body 2, and respectively abut against the upper portion 231 and the side portion 232 of the support edge 23 to completely cover the opening 22 of the box body 2 so as to provide airtight, waterproof and dust-proof properties. The waterproof segment 32 covers and receives the pivot section 42 to protect the pivot mechanism and the engaging mechanism, and avoid permeation of water into the receiving space 21 through an engagement area of the upper cover 3 and the side cover 4. When the upper cover 3 and the side cover 4 cover the box body 2, the pivot segments 34 and the engaging segments 35 of the upper cover 3, the pivot pieces 421 and the pivot shafts 422 of the pivot section 42 of the side cover 4, and the abutment sections 44 of the side cover 4 are disposed at an outer side of the support edge 23, this arrangement is also advantageous for reducing permeation of water into the receiving space 21. Furthermore, by means of the waterproof segment 32 and the inclined extension of the side cover 4 along with the side portion 232 of the support edge 23, the water on the side cover 4 can be led to flow down along the side cover body 41 and the edge-covering section 43 without permeating into the box body 2.

In use, the side cover 4 is pivotable about the pivot section 42 relative to the upper cover 3 between the opened position and the closed position. Referring back to FIGS. 8 and 9, when the side cover 4 is at the opened position, the side cover 4 uncovers the side opening portion 222 of the opening 22, the abutment sections 44 of the side cover 4 abut respectively against the engaging grooves 353 of the extending member 351, the limit protrusions 36 abut against the support blocks 45, and the edge-covering section 43 of the side cover 4 is separated from the support edge 23 so as to maintain the side cover 4 at the opened position and so that it is convenient to take out the articles stored in the box body 2. Further referring back to FIGS. 2 and 6, switch of the side cover 4 from the opened position to the closed position can be easily achieved by pushing the side cover 4, and vice versa. The end limits of the pivotal movement of the side cover 4 relative to the upper cover 3 without hindrance from the box body 2 may be achieved by abutment of the waterproof segment 32 against the pivot section 42 and abutment of the extending members 351 against the side cover body 41.

The cover assembly of the disclosure is applicable to the openings 22 of a plurality of the box bodies 2, and can be modified in size or shape to accommodate that of the storage box.

In the description above, for the purposes of explanation, numerous specific details have been set forth in order to provide a thorough understanding of the embodiment. It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular future, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiment, it is understood that this disclosure is not limited to the disclosed embodiment but is intended to cover various arrangements included within the spirit and scope of the interpretation so as to encompass all such modifications and equivalent arrangements.

What is claimed is:

1. A storage box comprising:

a box body defining a receiving space, and having an opening that is in spatial communication with said receiving space, and that has an upper opening portion and a side opening portion;

an upper cover having an upper cover body that covers removably said upper opening portion of said opening of said box body, a waterproof segment that has opposite ends, and a side edge interconnecting said opposite ends and connected to a portion of a periphery of said upper cover body, and two pivot segments that are connected respectively to said opposite ends of said waterproof segment; and a side cover having a side cover body that covers removably said side opening portion of said opening, and a pivot section that has opposite ends connected respectively and pivotally to said pivot segments of said upper cover, and a side edge interconnecting said opposite ends and connected to a portion of a periphery of said side cover body, said pivot section being covered by and received in said waterproof segment of said upper cover.

2. The storage box as claimed in claim 1, wherein:

said upper cover further has two engaging segments that are connected respectively to said pivot segments;

said side cover further has two abutment sections that are connected respectively to said opposite ends of said pivot section;

said side cover is pivotable about said pivot portion relative to said upper cover between an opened position, where said side cover uncovers said side opening portion of said opening, and a closed position, where said side cover covers said side opening portion; and said abutment sections of said side cover abut respectively against said engaging segments of said upper cover when said side cover is at the opened position for maintaining said side cover at the opened position.

3. The storage box as claimed in claim 2, wherein: said side cover further has at least one support block provided on said pivot section; and said upper cover further has at least one limit protrusion provided on said waterproof segment and abutting against said at least one support block when said side cover is at the opened position.

4. The storage box as claimed in claim 3, wherein: said side cover has a plurality of said support blocks; and said upper cover has a plurality of said limit protrusions abutting respectively against said support blocks when said side cover is at the opened position.

5. The storage box as claimed in claim 2, wherein: said pivot segments of said upper cover are symmetrical to each other;

each of said pivot segments of said upper cover has a pivot plate that is formed with a pivot hole;

each of said engaging segments of said upper cover has an extending member that extends from said pivot plate of a respective one of said pivot segments, that cooperates with said pivot plate of the respective one of said pivot segments to form a slot therebetween to permit said extending member to bend relative to said pivot plate of the respective one of said pivot segments, and that has an engaging groove;

said pivot section of said side cover has two pivot pieces that are connected respectively to said opposite ends of said pivot section and that are symmetrical to each other, and two pivot shafts that extend respectively from said pivot pieces, each of said pivot shafts engaging rotatably said pivot hole of a respective one of said pivot segments; and said abutment sections of said side cover extend respectively from said pivot pieces, each of said abutment sections engaging said engaging groove of said engaging segments when said side cover is at the opened position.

6. The storage box as claimed in claim 5, wherein: said upper cover further has an edge-covering segment connected to the remainder of said periphery of said upper cover body and coupled removably to said box body; and said side cover further has an edge-covering section connected to the remainder of said periphery of said side cover body and coupled removably to said box body.

7. The storage box as claimed in claim 6, wherein: said box body further has a support edge defining said opening;

said edge-covering segment of said upper cover abuts removably against said support edge;

said edge-covering section of said side cover abuts against said support edge when said side cover is at the closed position, and is separated from said support edge when said side cover is at the opened position; and said pivot segments and said engaging segments of said upper cover, said pivot pieces and said pivot shafts of said pivot section of said side cover, and said abutment section of said side cover are disposed at an outer side of said support edge.

8. The storage box as claimed in claim 1, wherein said side cover further has a plurality of reinforcing ribs connected to said side cover body and said pivot section.

9. A cover assembly adapted for covering removably a box body of a storage box, the box body defining a receiving space, and having an opening that is in spatial communication with the receiving space, and that has an upper opening portion and a side opening portion, said cover assembly comprising:

an upper cover having an upper cover body that is adapted for covering removably the upper opening portion of the opening of the box body, a waterproof segment that has opposite ends, and a side edge interconnecting said opposite ends and connected to a portion of a periphery of said upper cover body, and two pivot segments that are connected respectively to said opposite ends of said waterproof segment; and a side cover having a side cover body that is adapted for covering removably the side opening portion of the opening, and a pivot section that has opposite ends connected respectively and pivotally to said pivot segments of said upper cover, and a side edge interconnecting said opposite ends and connected to a portion of a periphery of said side cover body, and that is covered by and received in said waterproof segment of said upper body.

* * * * *